US008203094B2

(12) United States Patent
Mittleman et al.

(10) Patent No.: US 8,203,094 B2
(45) **Date of Patent: *Jun. 19, 2012**

(54) SWITCH ASSEMBLY CONSTRUCTIONS

(75) Inventors: Adam Duckworth Mittleman, San Francisco, CA (US); Tang Yew Tan, Palo Alto, CA (US); Erik L. Wang, Redwood City, CA (US); Richard Hung Minh Dinh, San Jose, CA (US); Phillip Michael Hobson, Menlo Park, CA (US); Kenneth A. Jenks, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/975,552

(22) Filed: Dec. 22, 2010

(65) Prior Publication Data

US 2011/0120850 A1 May 26, 2011

Related U.S. Application Data

(63) Continuation of application No. 11/824,191, filed on Jun. 28, 2007, now Pat. No. 7,880,106.

(51) Int. Cl.
*H01H 5/18* (2006.01)

(52) U.S. Cl. ..... 200/406

(58) Field of Classification Search ..... 200/406, 200/5 A, 275, 516, 521, 512, 517, 288, 293, 200/294, 296

See application file for complete search history.

(56) References Cited

U.S. PATENT DOCUMENTS

| | | | | |
|---|---|---|---|---|
| 4,033,030 | A * | 7/1977 | Robinson et al. | 29/622 |
| 4,349,712 | A | 9/1982 | Michalski | |
| 4,430,531 | A * | 2/1984 | Wright | 200/5 A |
| 4,463,234 | A | 7/1984 | Bennewitz | |
| 4,476,355 | A | 10/1984 | Mital | |
| 4,703,139 | A | 10/1987 | Dunlap | |
| 7,880,106 | B2 * | 2/2011 | Middleman et al. | 200/406 |
| 2005/0119681 | A1 | 6/2005 | Marshall et al. | |

* cited by examiner

*Primary Examiner* — Edwin A. Leon
(74) *Attorney, Agent, or Firm* — Kramer Levin Naftalis & Frankel LLP

(57) ABSTRACT

Electronic devices are provided with switch assembly input components that can have adhesives adhered to the side and/or bottom surfaces of support plates for retaining switches between the adhesives and the tops of the support plates. The switch assembly input components can include buttons with one or more absorption elements for receiving impact energy, reducing the impact energy, and transferring the reduced impact energy onto the switches.

35 Claims, 6 Drawing Sheets

SWITCH ASSEMBLY CONSTRUCTIONS

CROSS-REFERENCE TO RELATED APPLICATION

This is a continuation of, commonly-assigned U.S. patent application Ser. No. 11/824,191, filed Jun. 28, 2007 now U.S. Pat. No. 7,880,106, which is fully incorporated herein by reference.

FIELD OF THE INVENTION

This can relate to apparatus and methods for improving the construction of switch assemblies of electronic devices.

BACKGROUND OF THE DISCLOSURE

There is a need for improving the construction of switch assemblies of various electronic devices. Specifically, there is a need for reducing the size of switch assemblies of various electronic devices.

Some known electronic devices (e.g., MP3 players and portable telephones) include at least one input component that allows a user to manipulate the function of the device, at least one output component that provides the user with valuable device generated information, and a protective housing that at least partially encloses the input and output components. Some known input components are conventional switch assemblies that may include a switch (e.g., a dome switch) affixed to a support plate by an adhesive. The adhesive typically is layered over the switch and adhered to the top of the support plate surrounding the switch. Switch manufacturers typically specify a minimum adhesion border around the switch needed for proper adhesion of the adhesive to the top of the support plate.

However, as electronic devices become smaller, the size of the switch assemblies also may need to be reduced. In conventional switch assemblies, the reduction in the size of the assemblies can be limited, at least in part, by the minimum adhesion border specified by the switch manufacturers.

Accordingly, what is needed are apparatus and methods for reducing the size of switch assemblies while limiting the need for adhesion borders.

SUMMARY OF THE DISCLOSURE

Apparatus and methods for improving the construction of switch assemblies of electronic devices are provided.

According to a particular embodiment of the present invention, there is provided a switch assembly that includes a support plate, a switch, and an adhesive. The adhesive is adhered to at least one of a side surface of the support plate and a bottom surface of the support plate for retaining the switch between the adhesive and a top surface of the support plate.

According to another particular embodiment of the present invention, there is provided a switch assembly that includes a support plate, a switch, an adhesive, a user button, and at least one absorption element. The adhesive is adhered to the support plate for retaining the switch between the adhesive and a top surface of the support plate. The user button is for deforming the switch in a first direction with a first force when the user button is pushed in a second direction with a second force. The at least one absorption element is coupled to the user button for reducing the second force to the first force.

According to yet another particular embodiment of the present invention, there is provided a method of forming a switch assembly including a switch, a support plate, and an adhesive. The method includes placing the switch on a top surface of the support plate, wrapping the adhesive over the switch, and adhering the adhesive to at least one of a side surface of the support plate and a bottom surface of the support plate for retaining the switch between the adhesive and the top surface of the support plate.

BRIEF DESCRIPTION OF THE DRAWINGS

The above and other features of the present invention, its nature and various advantages will become more apparent upon consideration of the following detailed description, taken in conjunction with the accompanying drawings, in which like reference characters refer to like parts throughout, and in which.

DETAILED DESCRIPTION OF THE DISCLOSURE

Apparatus and methods for improving the construction of switch assemblies of electronic devices are provided and described with reference to

FIGS. 1-11.

Figure 1:
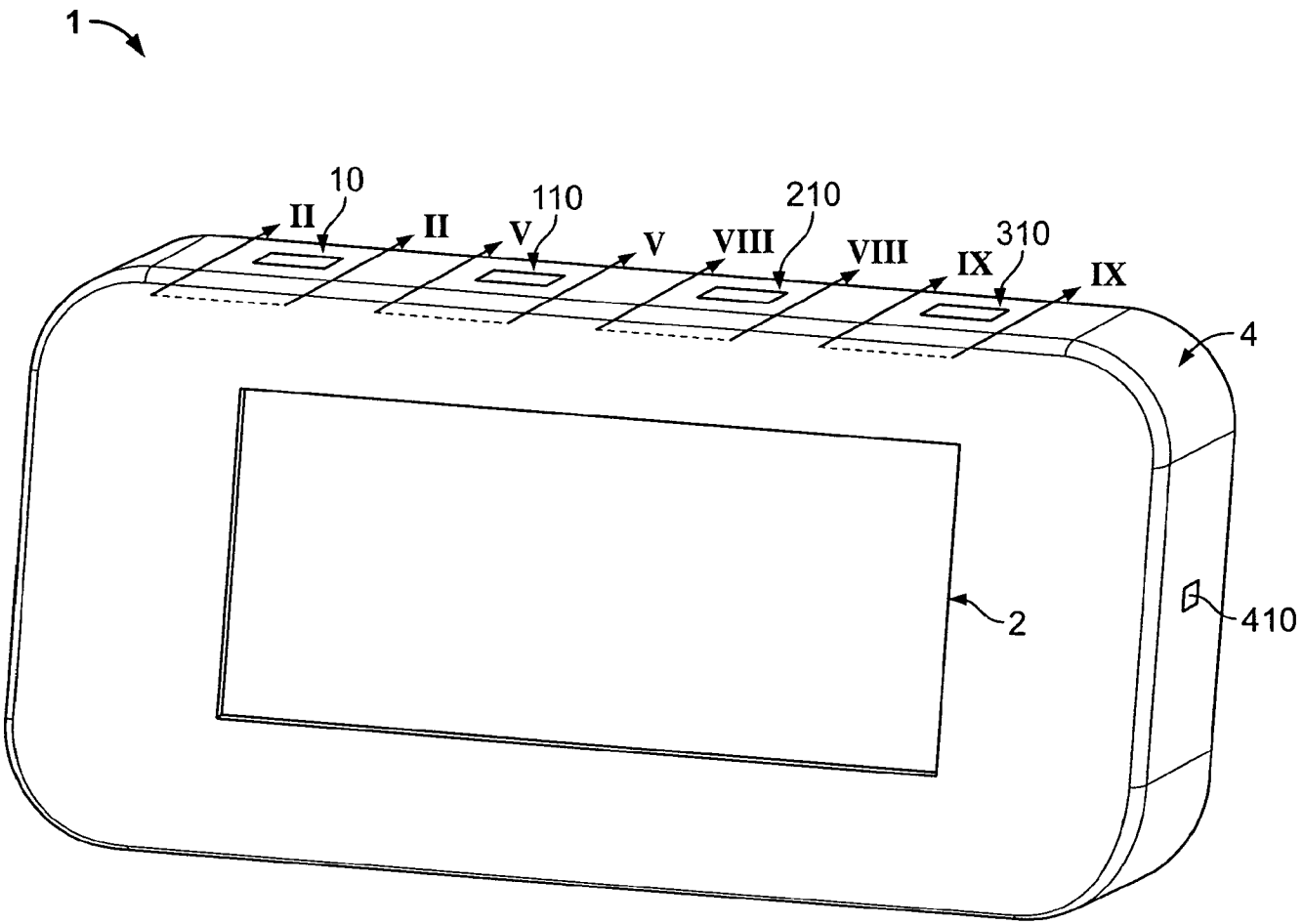
FIG. 1 is a perspective view of an exemplary electronic device in accordance with the principles of the present invention.

FIG. 1 shows an embodiment of electronic device 1 including at least one switch assembly input component of the invention. The term "electronic device" can include, but is not limited to, music players, video players, still image players, game players, other media players, music recorders, video recorders, cameras, other media recorders, radios, medical equipment, calculators, cellular telephones, other wireless communication devices, personal digital assistants, programmable remote controls, pagers, laptop computers, printers, or combinations thereof. In some cases, the electronic devices may perform a single function (e.g., a device dedicated to playing music) and, in other cases, the electronic devices may perform multiple functions (e.g., a device that plays music, displays video, stores pictures, and receives and transmits telephone calls).

In any case, these electronic devices are generally any portable, mobile, hand-held, or miniature electronic device having an input component constructed in accordance with the principles of the present invention so as to allow a user to listen to music, play games, record videos, take pictures, and/or conduct telephone calls wherever the user travels. Miniature electronic devices may have a form factor that is smaller than that of hand-held electronic devices, such as an iPod$^{TM}$ available by Apple Inc. of Cupertino, Calif. Illustrative miniature electronic devices can be integrated into various objects that include, but are not limited to, watches, rings, necklaces, belts, accessories for belts, headsets, accessories for shoes, virtual reality devices, other wearable electronics, accessories for sporting equipment, accessories for fitness equipment, key chains, or combinations thereof. Alternatively, electronic devices that incorporate an input component of the invention may not be portable at all.

Electronic device 1 can include at least one input component (see, e.g., input component 10) that allows a user to manipulate a function of the device, at least one output component (see, e.g., output component 2) that provides the user with valuable device generated information, and a protective housing (see, e.g., housing 4) that at least partially encloses the one or more input and output components of the device.

As shown in FIG. 1, for example, housing 4 of device 1 can be hexahedral. Although, it should be noted that housing 4 of device 1 is only exemplary and need not be substantially hexahedral, and that, in certain embodiments, the housing of device 1 could generally be formed in any other suitable shape, including, but not limited to, substantially spherical, ellipsoidal, conoidal, octahedral, or a combination thereof, for example.

As described above, a disadvantage of conventional electronic devices is that the reduction of their size can be limited by certain switch assembly input components with adhesives requiring specific adhesion border dimensions on the tops of support plates about switches. Therefore, according to certain embodiments of the present invention, device 1 can include at least one input component that is a switch assembly whose size is not limited by adhesion border dimensions on the top surface of a support plate about a switch.

For example, as shown in FIGS. 1-4, input component 10 can be a switch assembly that may include a switch 20, a support plate 30, and an adhesive 40.

Switch 20 may be retained between support plate 30 and adhesive 40 by adhering at least a portion of adhesive 40 to support plate 30. A user (not shown) may activate switch assembly 10 of device 1 by exerting an activation force on top surface 22 of switch 20 in the direction of arrow A (see, e.g., FIGS. 2 and 3). This user activation force may depress or deform switch 20 from an original position (e.g., as shown in FIG. 2) to an actuated position (e.g., as shown in FIG. 3) to change a functional state of device 1 (e.g., whether the device should power up or turn itself off).

Figure 2:
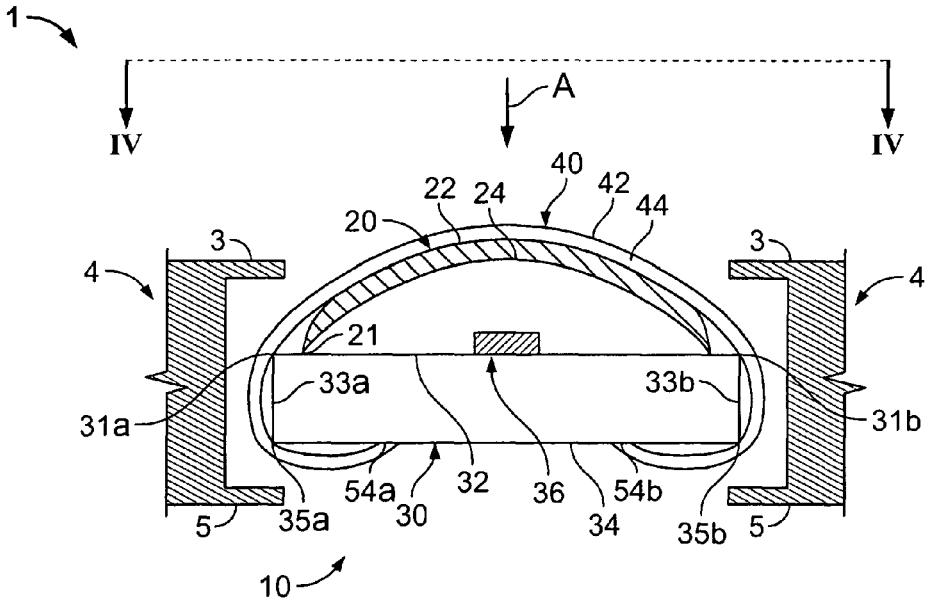
FIG. 2 is a partial horizontal cross-sectional view of the electronic device of FIG. 1, taken from line II-II of FIG. 1, showing a switch assembly in an original position in accordance with the principles of the present invention.
Figure 3:
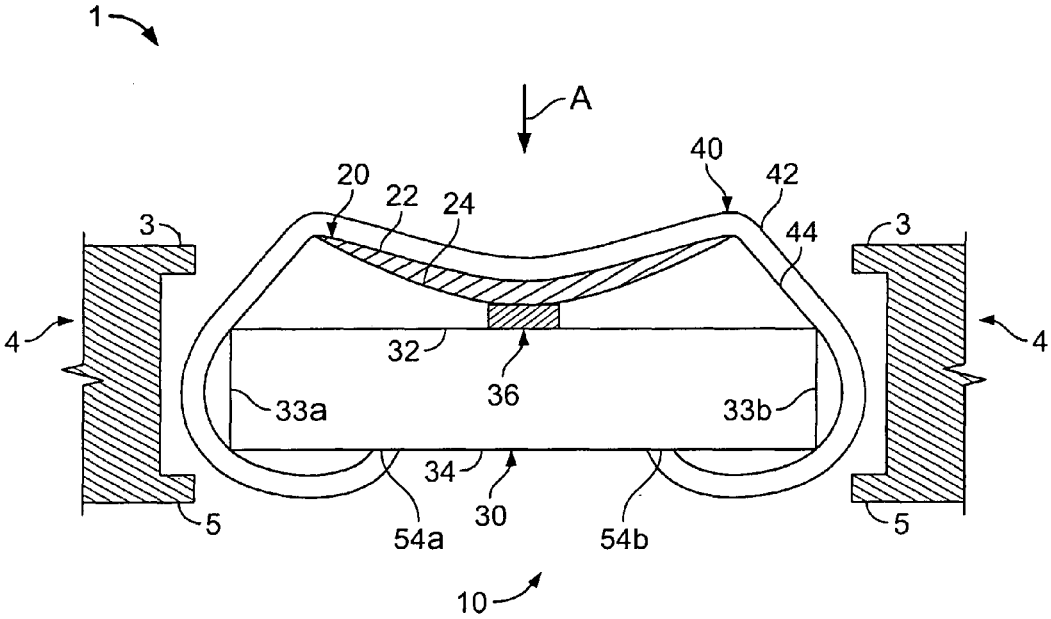
FIG. 3 is a partial horizontal cross-sectional view of the electronic device of FIGS. 1 and 2, similar to FIG. 2, showing the switch assembly of FIG. 2 in an actuated position in accordance with the principles of the present invention.

As shown in FIGS. 2 and 3, for example, switch assembly input component 10 can also include one or more contact points (e.g., contact point 36). Contact point 36 may be provided on support plate 30. Each of the one or more contact points 36 of input component 10 can be coupled to a processor (not shown, but described in greater detail hereinbelow) of device 1 contained within housing 4. When switch 20 is at its actuated position of FIG. 3, bottom surface 24 of switch 20 may contact or otherwise impart an activation energy onto contact point 36. This interaction between bottom surface 24 of switch 20 and contact point 36 may change a function or logic of the processor of device 1.

When the user terminates the activation force on top surface 22 of switch 20, switch 20 may return to its original position of FIG. 2, thereby terminating its activation energy onto contact point 36. It is to be understood, however, that although described above to include a contact point 36 on support plate 30, switch assembly 10 may be configured in various other suitable ways such that activation of switch 20 from its original position to its actuated position can change a functional state of device 1 within the spirit and scope of the present invention.

Switch 20 may be a dome-shaped switch, a snap-acting pressure disc, a snap-acting force disc, a low profile tactile switch, or any other suitable type of switch. Switch 20 may be an elastically deformable switch. Switch 20 may be made of any suitable material, including, but not limited to, metal (e.g., stainless steel), plastic, or combinations thereof.

Figure 11:
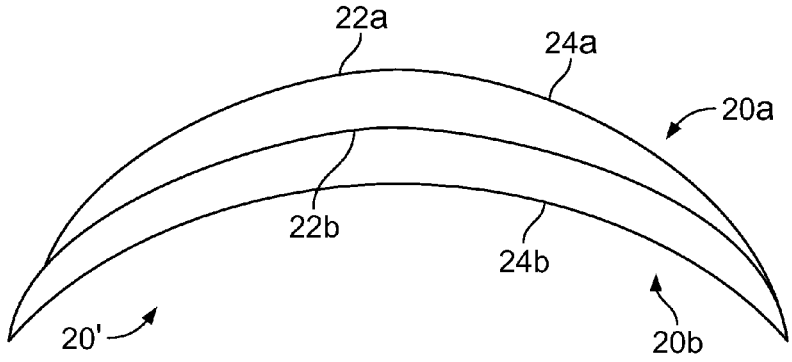
FIG. 11 is a partial horizontal cross-sectional view, similar to FIG. 2, of another embodiment of a switch in accordance with the principles of the present invention.

In some embodiments, switch 20 may include a single switch (e.g., a single dome-shaped switch as shown in FIGS. 2 and 3, for example). In other embodiments, a switch may include two or more switches coupled to one another or at least placed on top of one another in a stack. As shown in FIG. 11, for example, stacked switch 20' may include two switches 20A and 20B in a stack. Top surface 22A of switch 20A may act similarly to top surface 22 of switch 20, and bottom surface 24B of switch 20B may act similarly to bottom surface 24 of switch 20. In some embodiments, bottom surface 24A of switch 20A may be coupled to top surface 22B of switch 20B using any suitable adhesive or glue therebetween, for example.

Stacked switch 20' may be used in switch assemblies of the present invention similarly to how switch 20 is used in assembly 10. However, if stacked switch 20' is provided with two switches in its stack (e.g., as shown in FIG. 11), the actuation point of the stacked switch 20' may be double that of each individual switch in the stack. For example, if each of switches 20A and 20B is provided with an actuation force of 2 Newtons, stacked switch 20' may have an actuation force of 4 Newtons. However, if single switch 20 of FIG. 2 were provided with an actuation force of 4 Newtons, the switch may have a shorter life or require a larger diameter than a 4 Newton switch provided by stacked switches (e.g., switch 20'), due to the higher internal stresses in the single switch, for example.

Switch assembly input component 10 can be held in place at least partially within housing 4 in any one of various suitable ways such that at least top surface 22 of switch 20 is accessible to a user external to housing 4. For example, as shown in FIGS. 2 and 3, plate 30 can be held in place about its top surface 32 and bottom surface 34 by external bracket portions 3 and internal bracket portions 5 of housing 4, respectively. Housing 4 is not shown in many of the other illustrations described below (e.g., FIGS. 4-8) for the sake of clarity only.

In one embodiment of the invention, a switch may be retained between a top surface of a support plate and an adhesive by layering the adhesive over the switch and adhering at least a portion of the adhesive to a bottom surface of the support plate. For example, as shown in FIGS. 2 and 3, switch 20 may be retained between top surface 32 of support plate 30 and adhesive 40 by adhering at least a portion of adhesive 40 to bottom surface 34 of support plate 30. Adhesive 40 may include an exterior surface 42 and an interior surface 44. Interior surface 44 of adhesive 40 may be layered over top surface 22 of switch 20, wrapped about side surfaces 33 of support plate 30, and adhered to at least a portion of bottom surface 34 of support plate 30 (e.g., at one or more bottom adhering portions 54), such that switch 20 may be retained between top surface 32 of support plate 30 and adhesive 40. By adhering at least a portion of interior surface 44 of adhesive 40 to at least a portion of bottom surface 34 of support plate 30 at one or more bottom adhering portions 54, switch 20 can be retained between adhesive 40 and support plate 30 without adhering any portion or at least any substantial portion of adhesive 40 to any portion of top surface 32 of support plate 30. Therefore, the size of switch assembly 10 need not be limited by any specific adhesion border dimensions of top surface 32 of support plate 30 about switch 20.

Figure 4:
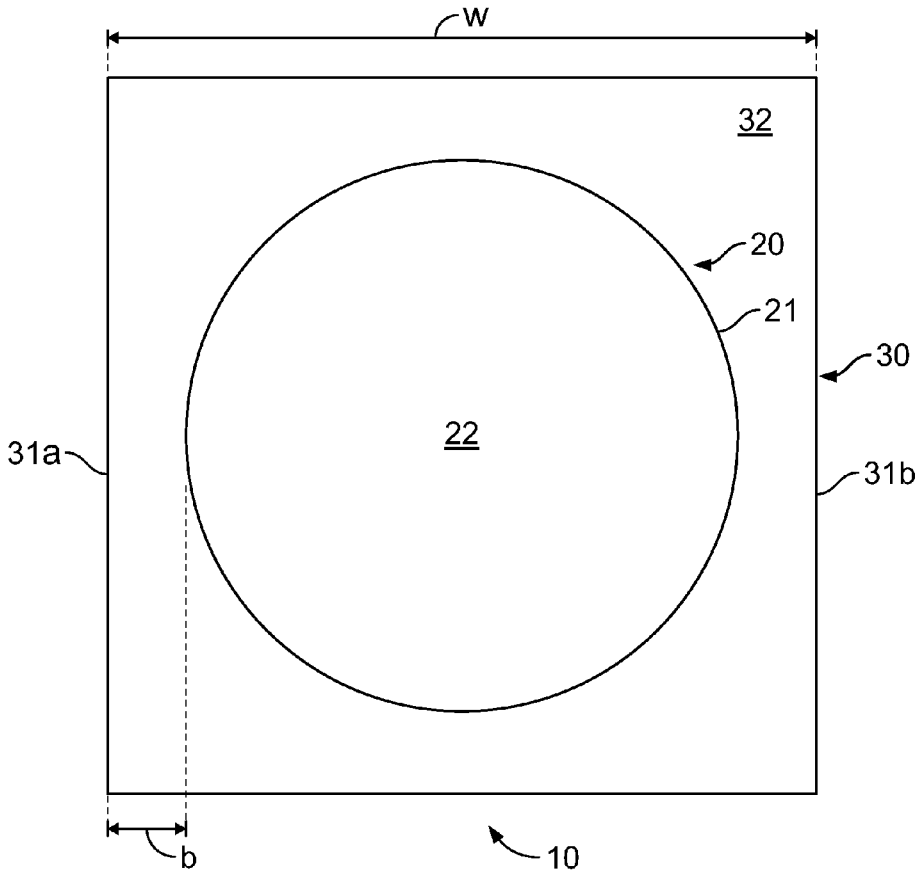
FIG. 4 is a top elevational view of the electronic device of FIGS. 1-3, taken from line IV-IV of FIG. 2, showing the switch assembly of FIGS. 2 and 3, but with the housing of the electronic device and the adhesive of the switch assembly omitted.

For example, as shown in FIG. 4 (without housing 4 and adhesive 40 for sake of clarity), the dimensions by which top surface 32 of support plate 30 extend beyond the edge (e.g., edge 21 between surfaces 22 and 24) of switch 20 need not be of at least a specific size for allowing proper adhesion of adhesive 40 to top surface 32 about switch 20. Distance b between the edge of switch 20 and the edge of top surface 32 (e.g., edge 31) for example, may be reduced to minimize the overall size of support plate 30 (e.g., total width w of top surface 32). Although, top surface 22 of switch 20 is shown to be substantially circular and top surface 32 of plate 30 is shown to be substantially rectangular, it should be noted that each of top surfaces 22 and 32 of FIGS. 2-4 is only exemplary, and that, in certain embodiments, one or both of top surfaces 22 and 32 could generally be formed in any other suitable shape, including, but not limited to, substantially triangular, elliptical, octagonal, or a combination thereof, for example.

An adhesive may be wrapped about the side surfaces and adhered to at least a portion of the bottom surface of a support plate such that the adhesive may substantially only contact the intersects (i.e., "edges" if the intersects are of two walls, and "corners" if the intersects are of three walls (or three edges)) of the side surfaces and may not contact the walls of the side surfaces themselves and/or the wall of the top surface itself. As shown in the left side of FIGS. 2 and 3, for example, interior surface 44 of adhesive 40 may only substantially contact the wall of bottom surface 34 (e.g., at bottom adhering portion 54*a*), edge 31*a* (i.e., the edge formed by the intersection of side surface 33*a* and top surface 32), and edge 35*a* (i.e., the edge formed by the intersection of side surface 33*a* and bottom surface 34). Adhesive 40 may not substantially contact the wall of side surface 33*a* itself.

Similarly, as shown in the right side of FIGS. 2 and 3, for example, interior surface 44 of adhesive 40 may only substantially contact the wall of bottom surface 34 (e.g., at bottom adhering portion 54*b*), edge 31*b* (i.e., the edge formed by the intersection of side surface 33*b* and top surface 32), and edge 35*b* (i.e., the edge formed by the intersection of side surface 33*b* and bottom surface 34). Adhesive 40 may not substantially contact the wall of side surface 33*b* itself. Moreover, in one embodiment, adhesive 40 may contact edge 31*a* and edge 31*b* without substantially contacting the wall of top surface 32 itself. Any suitable sticky material may be provided along one or more various portions of interior surface 44 of adhesive 40 for retaining switch 20 between adhesive 40 and plate 30.

According to another embodiment of the invention, one or more perforations may be included at one or more portions of an adhesive for providing bend relief such that the adhesive may better conform to the shape of the support plate. As shown in FIGS. 1 and 5-7, for example, device 1 may include a switch assembly 110 that may be similar to switch assembly 10 but includes an adhesive 140 with one or more perforation portions. Adhesive 140 of switch assembly 110 may be provided with a perforation portion 141*a* at the location where interior surface 144 of adhesive 140 contacts edge 131*a* of support plate 130. Perforation portion 141*a* may permit interior surface 144 of adhesive 140 adjacent perforation portion 141*a* to better bend about edge 131*a* and adhere or at least conform to a greater portion of one or more of the wall surfaces of support plate 130 adjacent edge 131*a* (e.g., the wall of top surface 132 and/or the wall of side surface 133*a*).

Figure 5:
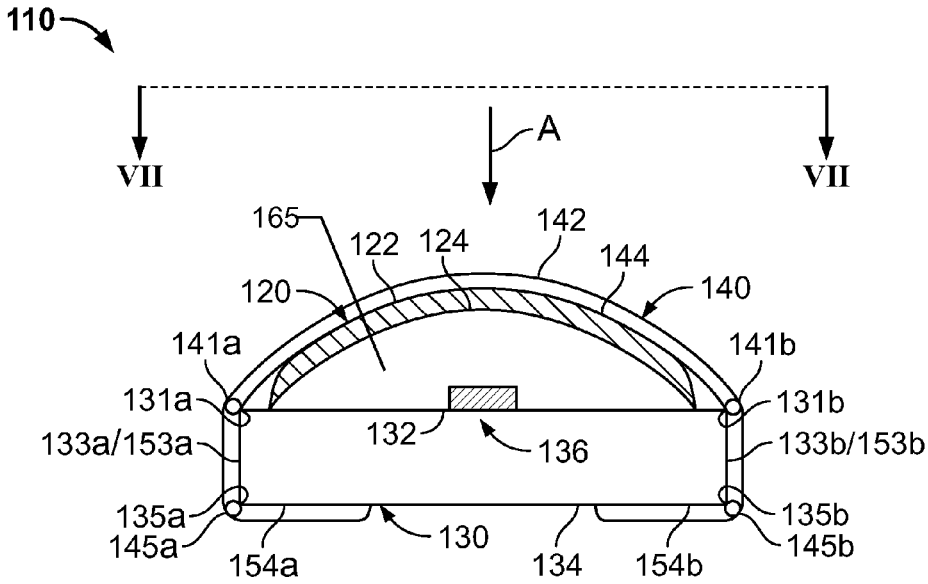
FIG. 5 is a partial horizontal cross-sectional view of the electronic device of FIGS. 1-4, taken from line V-V of FIG. 1, showing another switch assembly in an original position in accordance with the principles of the present invention, but with the housing of the electronic device omitted.
Figure 6:
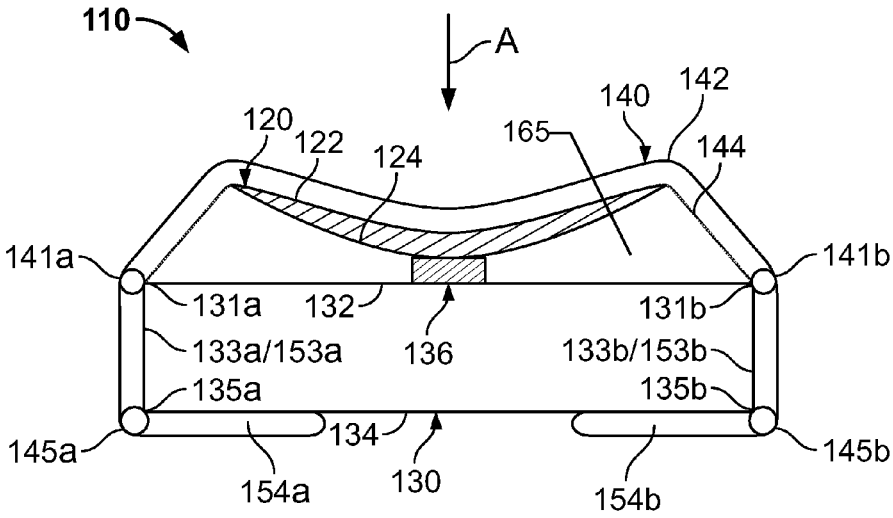
FIG. 6 is a partial horizontal cross-sectional view of the electronic device of FIGS. 1-5, similar to FIG. 5, showing the switch assembly of FIG. 5 in an actuated position in accordance with the principles of the present invention.
Figure 7:
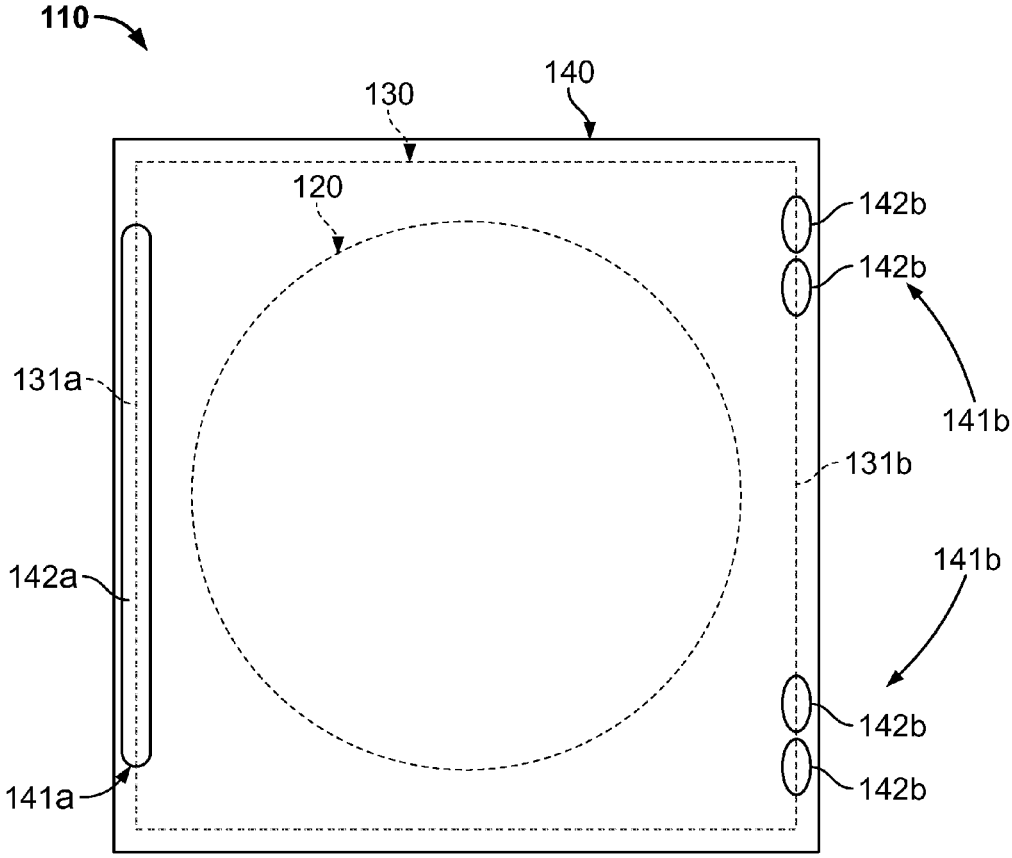
FIG. 7 is a top elevational view of the electronic device of FIGS. 1-6, taken from line VII-VII of FIG. 5, showing the switch assembly of FIGS. 5 and 6.

Adhesive 140 may alternatively or additionally be provided with perforation portions at one or more of the other locations where adhesive 140 contacts an edge of support plate 130 (e.g., perforation portions 141*b*, 145*a*, and 145*b*), as shown in FIGS. 5-7. Perforation portions 141*b*, 145*a*, and 145*b*, along with perforation portion 141*a*, may allow adhesive 140 to bend about each edge (e.g., edges 131*a*, 131*b*, 135*a*, and 135*b*) and adhere or at least conform to substantially the entire wall of each side surface of the support plate (e.g., side surfaces 133*a* and 133*b* at side adhering portions 153*a* and 153*b*). Each side adhering portion 153 may include multiple adhering instances spaced along its respective side surface 133 or it may include one adhering instance spanning a portion or substantially the entire length of its respective side surface 133. The perforation portions may allow adhesive 140 to adhere to greater portions of bottom surface 134 of support plate 130 (e.g., at one or more bottom adhering portions 154). Perforation portions 141*a* and 141*b* may also allow adhesive 140 to bend about edges 131*a* and 131*b* and adhere or at least conform to one or more portions of top surface 132.

Each of the one or more perforation portions provided on adhesive 140 may help facilitate the operation of switch 120 of assembly 110 by permitting air and other gas therethrough, and thereby reducing pressure that may otherwise be created under the switch during use. When switch 120 is depressed and moved in the direction of arrow A from its original position (see, e.g., FIG. 5) to its actuated position (see, e.g., FIG. 6), the area of space 165 defined by bottom surface 124 of switch 120, top surface 132 of plate 130, and interior surface 144 of adhesive 140 may be reduced. One or more perforation portions on adhesive 140 (e.g., perforation portions 141*a* and 141*b* of FIGS. 5-7) may permit air and other gas to pass therethrough between space 165 and the atmosphere external to switch assembly 110. Each perforation portion may be any type of hole, slit, or aperture created either partially or completely through adhesive 140 between surfaces 142 and 144.

A perforation portion may be provided by one perforation spanning one or more fractions or the entire portion of an adhesive where it contacts an edge of a support plate. Alternatively, a perforation portion may be provided by a plurality of perforations spaced along one or more fractions or the entire portion of an adhesive where it contacts an edge of a support plate. For example, as shown in FIG. 7 (with switch 120 and support plate 130 each shown in broken lines below adhesive 140), perforation portion 141*a* may include one perforation 142*a* spanning substantially the entire portion of adhesive 140 that contacts edge 131*a* of support plate 130. As also shown in FIG. 7, for example, perforation portion 141*b* may include a plurality of perforations 142*b* spanning separate fractions of the portion of adhesive 140 that contacts edge 131*b* of support plate 130 (e.g., each perforation may be in the shape of a dot or dash provided either partially or completely through the adhesive).

Figure 8:
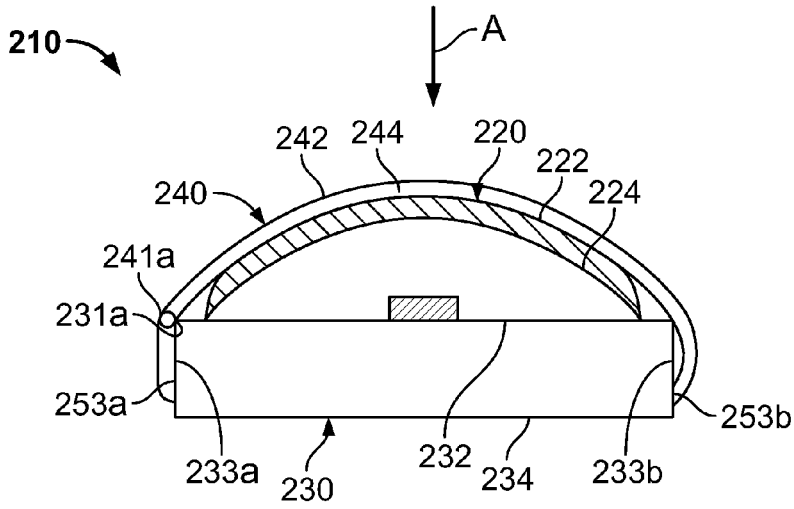
FIG. 8 is a partial horizontal cross-sectional view of the electronic device of FIGS. 1-7, taken from line VIII-VIII of FIG. 1, showing yet another switch assembly in an original position in accordance with the principles of the present invention, but with the housing of the electronic device omitted.

In one embodiment of the invention, a switch may be retained between a top surface of a support plate and an adhesive by layering the adhesive over the switch, adhering a first portion of the adhesive to a first side surface of the support plate, and adhering a second portion of the adhesive to a second side surface of the support plate. As shown in FIGS. 1 and 8, for example, device 1 may include a switch assembly 210 that may be similar to switch assembly 10 and switch assembly 110 but that may include a switch 220 retained between a top surface 232 of a support plate 230 and an adhesive 240 that does not adhere to bottom surface 234 of support plate 230. Instead, interior surface 244 of adhesive 240 may be layered over top surface 222 of switch 220, wrapped about side surfaces 233*a* and 233*b* of support plate 230, and adhered to at least a portion of each of side surfaces 233*a* and 233*b* of support plate 230 at one or more side adhering portions 253 (e.g., side adhering portions 253*a* and 253*b*).

By adhering at least a portion of interior surface 244 of adhesive 240 to at least a portion of each of side surfaces 233*a* and 233*b* of support plate 230 at one or more side adhering portions 253, switch 220 can be retained between adhesive 240 and support plate 230 without adhering any portion or at least any substantial portion of adhesive 240 to any portion of top surface 232 of support plate 230. Therefore, the size of switch assembly 210 need not be limited by any specific adhesion border dimensions of top surface 232 of support plate 230 about switch 220, as described above with respect to switch assembly 10 (see, e.g., FIG. 4).

Adhesive 240 may be provided with one or more perforation portions at one or more of the locations where adhesive 240 contacts an edge of support plate 230 (e.g., perforation portion 241*a* at edge 231*a*), as shown in FIG. 8, for example. As described above with respect to the perforation portions of FIGS. 5-7, perforation portion 241*a* may allow adhesive 240 to bend about edge 231*a* of support plate 230 and adhere or at least conform to a greater portion of side surface 233*a* of support plate 230. Therefore, perforation portion 241*a* may enlarge side adhering portion 253*a*. In some embodiments, surfaces or edges or corners of the support plate may be curved or smoothed to help the adhesive conform thereto. The support plate may be made of any suitable material, including, but not limited to, metal (e.g., stainless steel), PCB, plastic, and combinations thereof.

Figure 9:
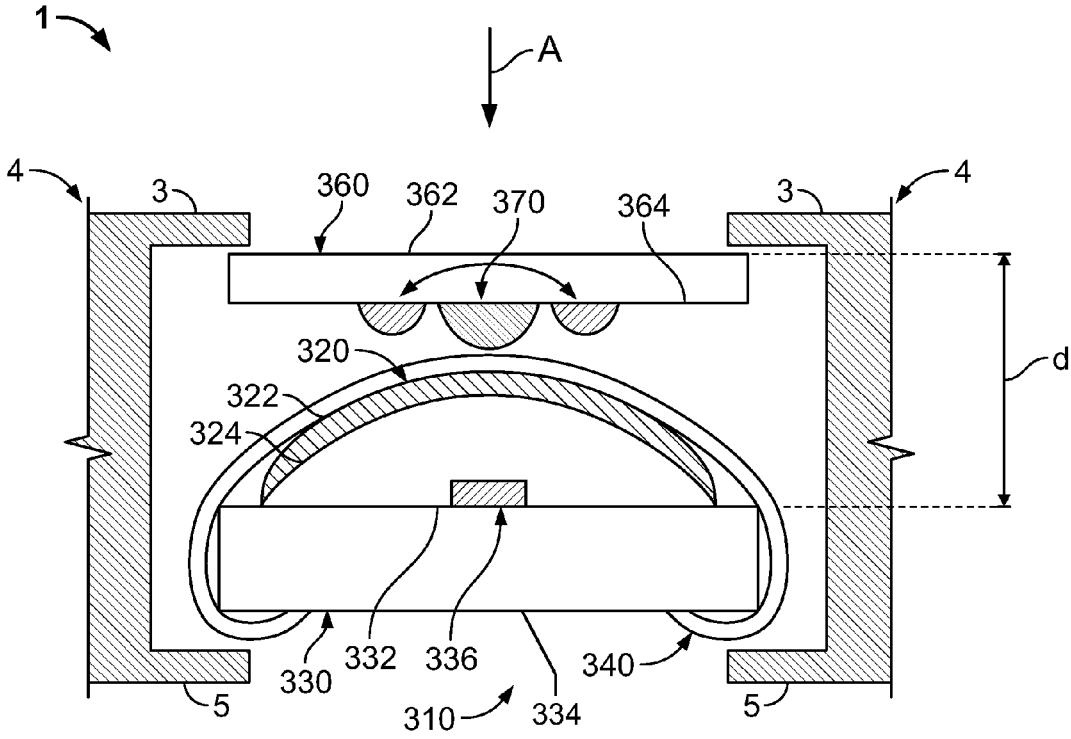
FIG. 9 is a partial horizontal cross-sectional view of the electronic device of FIGS. 1-8, taken from line IX-IX of FIG. 1, showing yet another switch assembly in an original position in accordance with the principles of the present invention.
Figure 10:
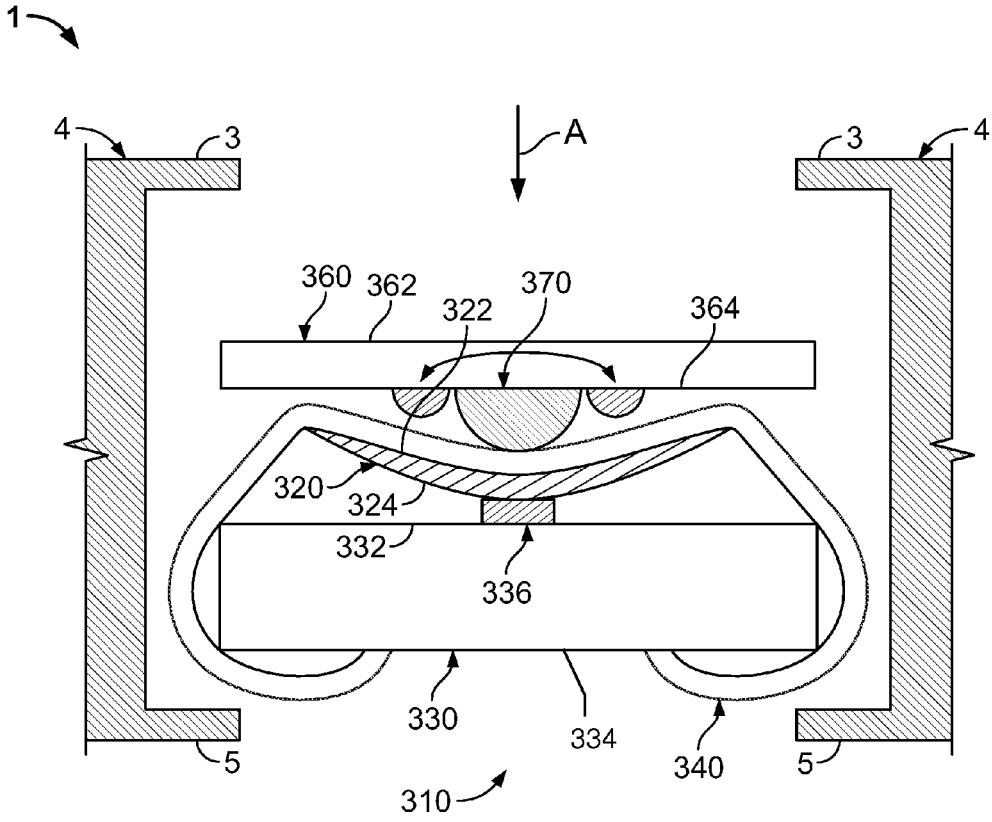
FIG. 10 is a partial horizontal cross-sectional view of the electronic device of FIGS. 1-9, similar to FIG. 9, showing the switch assembly of FIG. 9 in an actuated position in accordance with the principles of the present invention.

In an embodiment of the invention, a switch assembly may include a user button for receiving a user's input and thereby activating the switch of the switch assembly. As shown in FIGS. 1, 9, and 10, for example, device 1 may include a switch assembly 310, which may be similar to any of switch assemblies 10, 110, and/or 210 of the invention or which may be any known switch assembly. Switch assembly 310 may include a switch 320 resting on a top surface 332 of a support plate 330. An adhesive 340 may also be provided for retaining switch 320 between top surface 332 and the adhesive, as described above with respect to adhesives 40, 140, and/or 240. Switch assembly 310 may also include a user button 360 for receiving a user's input and thereby activating switch 320.

For example, a user (not shown) may activate switch assembly 310 of device 1 by exerting an activation force on top surface 362 of user button 360 in the direction of arrow A (see, e.g., FIGS. 9 and 10). This user activation force on button 360 may depress or deform switch 320 from an original position (e.g., as shown in FIG. 9) to an actuated position (e.g., as shown in FIG. 10) to change a functional state of device 1 (e.g., whether the device should power up or turn itself off).

Switch assembly 310 may also include one or more contact points (e.g., contact point 336). As shown in FIGS. 9 and 10, for example, contact point 336 may be provided on support plate 330. Each of the one or more contact points 336 of input component 310 can be coupled to a processor (not shown, but described in greater detail hereinbelow) of device 1 contained within housing 4. When switch 320 is at its actuated position of FIG. 10, bottom surface 324 of switch 320 may contact or otherwise impart an activation energy onto contact point 336. This interaction between bottom surface 324 of switch 320 and contact point 336 may change a function or logic of the processor of device 1.

When the user terminates the activation force on top surface 362 of button 360, switch 320 may return to its original position of FIG. 9, thereby terminating its activation energy onto contact point 336. It is to be understood, however, that although described above to include a contact point 336 on support plate 330, switch assembly 310 may be configured in various other suitable ways such that activation of switch 320 from its original position to its activation position can change a functional state of device 1 within the spirit and scope of the present invention.

Switch assembly input component 310 can be held in place at least partially within housing 4 in any one of various suitable ways such that at least top surface 362 of button 360 is accessible to a user external to housing 4. For example, as shown in FIG. 9, assembly 310 can be held in place about top surface 362 of button 360 and bottom surface 334 of plate 330 by external bracket portions 3 and internal bracket portions 5 of housing 4, respectively.

In some embodiments of the invention, a switch assembly input component of electronic device 1 may be constructed with one or more impact absorption elements such that the switch assembly is resistant to severe impacts on housing 4 and/or the switch assembly itself. For example, as shown in FIGS. 9 and 10, switch assembly input component 310 of device 1 may be provided with one or more impact absorption elements 370 such that switch assembly 310 may absorb direct impacts without damaging or destroying the switch assembly itself.

As described above, user button 360 of assembly 310 may be operative to actuate switch 320 in response to a user press on top surface 362 in the direction of arrow A. Switch 320 may be any suitable switch, including, for example, a dome switch. Switch 320 may be pre-loaded to provide tactile feedback when the user presses button 360. In some embodiments, button 360 may be constructed from a hard material (e.g., a hard plastic) to increase the tactile feedback from actuation of button 360.

A number of different approaches may be used to limit the damage to button 360 and switch 320 caused by impacts (e.g., to prevent switch 320 from becoming stuck in an inverted, bi-stable position). In some embodiments, button 360 may be constructed from a soft material (e.g., an elastomer) to absorb impacts. In some embodiments, button 360 and switch 320 may be constructed such that the overall depth of switch assembly 310 (see, e.g., depth d of FIG. 9) is large enough to absorb impacts on button 360. For example, some existing switch assembly input mechanisms use tactile switches and side-tactile switches having depths that range from between about 5.25 millimeters and about 6.70 millimeters (e.g., the switch assemblies used in the RAZR™ and KRZR™ cellular telephones available by Motorola, Inc. of Chicago, Ill.). These relatively large depths may allow the switches to absorb impacts and limit damage.

However, rather than increasing the size of the switch assembly input mechanism, depth d of switch assembly 310 may be reduced and other approaches may be used to reduce the damage of impacts on the switch assembly. For example, assembly 310 may be provided with one or more impact absorption elements 370 coupled to bottom surface 364 of button 320 such that switch assembly 310 may absorb direct impacts without damaging or destroying the switch assembly itself. Instead of bottom surface 364 contacting switch 320 (either directly or via an adhesive, such as adhesive 340, for example), the one or more absorption elements 370 may be operative to contact switch 320 (or adhesive 340) in response to user presses of top surface 362 in the direction of arrow A.

Each of the one or more absorption elements 370 may be constructed from any suitable material, including, for example, materials having properties that aid in absorbing the strength of impacts on button 360. For example, each of the one or more absorption elements 370 may be an elastomer that has a high Young's modulus to allow for extensive elastic deformation. When button 360 is subjected to an impact, button 360 may transfer the energy of the impact to one or more absorption elements 370, which may in turn absorb a significant portion of the energy of the impact, and finally provide a reduced portion of the energy of the impact to switch 320. By reducing the amount of energy transferred from button 360 to switch 320, each of the one or more absorption elements 370 may reduce the damage caused by impacts to switch assembly 310.

In some embodiments, each of the one or more absorption elements 370 may be twin shot molded with button 360 itself, rather than being a separate element that may require assembly and retention to the button. This may help keep depth d to a minimum. For example, button 360 may be a polycarbonate button twin shot molded with one or more absorption elements 370 of thermoplastic polyurethane (TPU) or any other type of thermoplastic elastomer (TPE). In some embodiments, because an absorption element of elastomer may be softer than a hard plastic absorption element, an elastomer absorption element of the present invention may be preloaded such that it may always be slightly compressed and such that it may help give the switch assembly a crispier and more tactile feel.

In some embodiments, button 360, each of the one or more absorption elements 370, and switch 320 may be constructed to reduce the overall depth d of switch assembly 310. For example, button 360, each of the one or more absorption elements 370, and switch 320 may be constructed such that the overall depth d of switch assembly 310 is about 2.1 millimeters. In some embodiments, the overall depth d of switch assembly 310 may be in the range of 0.5 millimeters to 3.5 millimeters. In some embodiments, the overall depth d of switch assembly 310 may be in the range of 1.0 millimeter to 3.0 millimeters. In some embodiments, the overall depth d of switch assembly 310 may be in the range of 1.5 millimeters to 2.5 millimeters. Despite being at least half as thin as the known switch assemblies described above, switch assembly 310 may be just as durable and just as able to absorb the energy of an impact thereon.

In certain embodiments, electronic device 1 can also include at least one user input component that may be of a variety of forms other than that of a switch assembly (e.g., input components 10, 110, 210, and 310). For example, as shown in FIG. 1, device 1 can also include one or more input components 410 that may take other various forms, including, but not limited to sliding switches, keypads, dials, scroll wheels, touch screen displays, electronics for accepting audio and/or visual information, antennas, infrared ports, or combinations thereof.

According to certain embodiments of the present invention, the position of one or more of input components 10, 110, 210, 310, and/or 410 can be widely varied relative to the position of another one or more of input components 10, 110, 210, 310, and/or 410. For example, they can be adjacent one another or spaced apart. Additionally, each one of the one or more input components 10, 110, 210, 310, and/or 410 can be placed at any external surface (e.g., top, bottom, side, front, back, or edge) of housing 4 that may be accessible to a user during manipulation of the electronic device.

Furthermore, in certain embodiments of the present invention, each one of the one or more input components 10, 110, 210, 310, and/or 410 of device 1 can be configured to provide one or more dedicated control functions for making selections or issuing commands associated with operating the device. By way of example, in the case of a music file player, the switch assembly functions of each one of components 10, 110, 210, and/or 310 can be associated with powering up or down the device, opening or closing a menu, playing or stopping a song, changing a mode, and the like.

As mentioned above, certain embodiments of electronic device 1 can also include at least one output component that provides the user with valuable device generated information. For example, as shown in FIG. 1, device 1 can also include one or more output components 2 that may take various forms, including, but not limited to audio speakers, headphones, audio line-outs, visual displays, antennas, infrared ports, or combinations thereof.

Furthermore, in certain embodiments of the present invention, each one of the one or more switch assembly input components 10, 110, 210, and/or 310 can be integrated with some other input component 410 and/or output component 2 on electronic device 1, such as switches, push-buttons, keys, dials, trackballs, joysticks, touch pads, touch screens, scroll wheels, displays, microphones, speakers, cameras, and the like. Each of these individual interfaces may include switch assemblies either incorporated therein, such as a switch assembly on a joystick, or forming an integral part thereof, such as a switch assembly with a push-button thereon.

Housing 4 of electronic device 1 can also include a processor (not shown), a storage device (not shown), communications circuitry (not shown), a bus (not shown), and a power supply (not shown) for powering the device. The bus of device 1 can provide a data transfer path for transferring data, to, from, or between at least the processor, the storage device, and the communications circuitry. The processor (not shown) of device 1 can control the operation of many functions and other circuitry included in the device 1. For example, the processor can receive user inputs from switch assembly input component 10 and drive output component 2.

The storage device (not shown) of device 1 can include one or more storage mediums, including, for example, a hard-drive, a permanent memory such as ROM, a semi-permanent memory such as RAM, or cache, that may store media (e.g., music and video files), software (e.g., for implementing functions on device 1), wireless connection information (e.g., information that may enable device 1 to establish wireless communication with another device or server), subscription information (e.g., information that keeps track of podcasts, television shows, or other media that the user subscribes to), and any other suitable data.

The communications circuitry (not shown) of device 1 can include circuitry for wireless communication (e.g., short-range and/or long-range communication). For example, the wireless communication circuitry of device 1 can be wi-fi enabling circuitry that permits wireless communication according to one of the 802.11 standards. Other wireless protocol standards could also be used, either in alternative or in addition to the identified protocol. Another network standard may be Bluetooth®. The communications circuitry can also include circuitry that enables device 1 to be electrically coupled to another device (e.g., a computer or an accessory device) and communicate with that other device. Furthermore, additional electrical components (not shown) can be provided by device 1 for sending and receiving media, including, but not limited to, microphones, amplifiers, digital signal processors (DSPs), image sensors (e.g., charge coupled devices (CCDs)) or optics (e.g., lenses, splitters, filters, etc.), antennas, receivers, transmitters, transceivers, and the like.

While there have been described electronic devices with switch assembly input components having adhesives adhered to the side and/or bottom surfaces of support plates for retaining switches between the adhesives and the tops of the support plates, it is to be understood that many changes may be made therein without departing from the spirit and scope of the present invention. It will also be understood that various directional and orientational terms such as "front" and "back," "left" and "right," "top" and "bottom," "side" and "edge" and "corner," "height" and "width" and "depth," and the like are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Those skilled in the art will appreciate that the invention can be practiced by other than the described embodiments, which are presented for purposes of illustration rather than of limitation, and the invention is limited only by the claims which follow.

What is claimed is:

1. A switch assembly, comprising:

a support plate comprising a top surface, a first side surface extending from the top surface, and a second side surface extending from the top surface;

a switch; and an adhesive spaced from the top surface and adhered to the first side surface and the second side surface for retaining the switch between the adhesive and the top surface.

2. The switch assembly of claim 1, wherein the first side surface is opposite the second side surface.

3. The switch assembly of claim 1, wherein:

the support plate further comprises a bottom surface; and the first side surface extends from the top surface to the bottom surface.

4. The switch assembly of claim 3, wherein the adhesive is adhered to the bottom surface.

5. The switch assembly of claim 3, wherein:

the adhesive comprises a perforation; and the perforation is located at a portion of the adhesive adjacent an intersection of the bottom surface and the first side surface.

6. The switch assembly of claim 1, wherein:

the adhesive comprises a perforation; and the perforation is located at a portion of the adhesive adjacent an intersection of the top surface and the first side surface.

7. The switch assembly of claim 1, wherein the adhesive comprises a perforation.

8. The switch assembly of claim 7, wherein the perforation permits fluid to pass through the perforation between the atmosphere external to the switch assembly and the space defined between the switch and the top surface.

9. The switch assembly of claim 7, wherein the perforation is provided only partially through the adhesive.

10. The switch assembly of claim 7, wherein the perforation is provided completely through the adhesive.

11. The switch assembly of claim 1, wherein the switch comprises an elastically deformable switch.

12. The switch assembly of claim 1, wherein the switch comprises one of a dome-shaped switch, a snap-acting pressure disc, a snap-acting force disc, and a low profile tactile switch.

13. The switch assembly of claim 1, wherein the switch includes a first dome switch element stacked on top of a second dome switch element.

14. The switch assembly of claim 1 further comprising:

a user button for deforming the switch in a first direction with a first force when the user button is pushed in a second direction with a second force; and at least one absorption element coupled to the user button for reducing the second force to the first force.

15. The switch assembly of claim 1 further comprising:

a user button; and an absorption element positioned between the user button and the switch.

16. The switch assembly of claim 15, wherein the absorption element is twin-shot molded with the user button.

17. The switch assembly of claim 16, wherein the user button comprises polycarbonate.

18. The switch assembly of claim 16, wherein the absorption element is a thermoplastic elastomer.

19. The switch assembly of claim 16, wherein the absorption element is a thermoplastic polyurethane.

20. The switch assembly of claim 15, wherein the distance between a top surface of the user button and a top surface of the support plate is between 0.5 millimeters and 3.5 millimeters.

21. The switch assembly of claim 15, wherein the distance between a top surface of the user button and a top surface of the support plate is between 1.5 millimeter and 2.5 millimeters.

22. The switch assembly of claim 1, wherein no portion of the adhesive contacts any portion of the top surface of the support plate.

23. The switch assembly of claim 22, wherein a portion of the adhesive contacts a portion of the intersect of the top surface and the first side surface.

24. A switch assembly, comprising:

a support plate;

a switch; and an adhesive adhered to the support plate for retaining the switch between the adhesive and a top surface of the support plate, wherein the adhesive is not adhered to the top surface of the support plate.

25. The switch assembly of claim 24, wherein:

the support plate comprises a first side surface extending from the top surface; and the adhesive is adhered to the first side surface.

26. The switch assembly of claim 25, wherein:

the support plate further comprises a second side surface extending from the top surface; and the adhesive is adhered to the second side surface.

27. The switch assembly of claim 25, wherein:

the adhesive comprises a perforation; and the perforation is located at a portion of the adhesive adjacent an intersection of the top surface and the first side surface.

28. The switch assembly of claim 24, wherein:

the support plate further comprises a bottom surface; and the adhesive is adhered to the bottom surface.

29. The switch assembly of claim 28, wherein:

the support plate comprises a first side surface extending from the bottom surface;

the adhesive comprises a perforation; and the perforation is located at a portion of the adhesive adjacent an intersection of the bottom surface and the first side surface.

30. The switch assembly of claim 24, wherein:

the support plate further comprises a bottom surface and a first side surface extending between top surface and the bottom surface; and the adhesive is adhered to at least one of the bottom surface, the first side surface, the first edge formed by the intersection of the bottom surface and the first side surface, and a second edge formed by the intersection of the top surface and the first side surface.

31. The switch assembly of claim 30, wherein:

the adhesive comprises a perforation; and the perforation is located at a portion of the adhesive adjacent one of the first edge and the second edge.

32. The switch assembly of claim 24, wherein the adhesive does not contact any portion of the top surface of the support plate.

33. A method of forming a switch assembly comprising:

positioning a switch between a first surface of a support plate and an adhesive; and adhering the adhesive to a second surface of the support plate that is distinct from the first surface for retaining the switch between the adhesive and the first surface of the support plate, wherein the adhering maintains separation between the adhesive and the first surface.

34. The method of claim 33, further comprising perforating a portion of the adhesive.

35. The method of claim 34, further comprising passing fluid through the perforated portion of the adhesive during operation of the switch assembly.

* * * * *

UNITED STATES PATENT AND TRADEMARK OFFICE

CERTIFICATE OF CORRECTION

PATENT NO. : 8,203,094 B2
APPLICATION NO. : 12/975552
DATED : June 19, 2012
INVENTOR(S) : Adam Duckworth Mittleman et al.

It is certified that error appears in the above-identified patent and that said Letters Patent is hereby corrected as shown below:

In the Claims:

Claim 30, Column 13, line 25 - Column 14, line 5, should be corrected as follows:

30. The switch assembly of claim 24, wherein: the support plate further comprises a bottom surface and a first side surface extending between the top surface and the bottom surface; and the adhesive is adhered to at least one of the bottom surface, the first side surface, a first edge formed by the intersection of the bottom surface and the first side surface, and a second edge formed by the intersection of the top surface and the first side surface.

Signed and Sealed this
Thirtieth Day of April, 2013

Teresa Stanek Rea
*Acting Director of the United States Patent and Trademark Office*